US006302166B1

(12) United States Patent
Caparros

(10) Patent No.: US 6,302,166 B1
(45) Date of Patent: Oct. 16, 2001

(54) SECONDARY CONTAINMENT CAP APPARATUS FOR ATTACHMENT TO A PRIMARY CHLORINE CONTAINER

(76) Inventor: Rudolph Caparros, 3641 Turnberry Cir., Santa Rosa, CA (US) 95430

( * ) Notice: Subject to any disclaimer, the term of this patent is extended or adjusted under 35 U.S.C. 154(b) by 0 days.

(21) Appl. No.: 09/501,911

(22) Filed: Feb. 10, 2000

Related U.S. Application Data

(63) Continuation-in-part of application No. 09/452,398, filed on Dec. 1, 1999.

(51) Int. Cl.[7] ..... B65B 1/04
(52) U.S. Cl. ..... 141/86; 141/311 A; 220/571
(58) Field of Search ..... 141/86, 88, 311 A; 220/571; 222/108

(56) References Cited

U.S. PATENT DOCUMENTS 4,988,020 * 1/1991 Webb ..... 222/608
5,538,052 * 7/1996 Harp ..... 141/86

* cited by examiner

*Primary Examiner*—Steven O. Douglas
(74) *Attorney, Agent, or Firm*—Frank L. Kubler

(57) ABSTRACT

A secondary containment cap apparatus is provided for securing to a primary container containing a hazardous fluid, the primary container having a primary container wall with a primary container hazardous fluid passing port and a primary container wall exterior surface, the secondary containment cap apparatus including a cap wall defining a concave cap interior and a cap abutment port, the cap abutment port having a cap port rim, the cap abutment port and cap port rim being configured to fit closely against and follow the primary container wall in sealing relation with the primary container wall exterior surface and thereby to enclose a region of the primary container wall exterior surface to provide secondary containment over the region of the primary container wall exterior surface; a mechanism for controlled release of the fluid through the cap wall; and a mechanism for securing the cap wall to the primary container so that the cap port rim rests against the primary container wall exterior surface.

3 Claims, 4 Drawing Sheets

SECONDARY CONTAINMENT CAP APPARATUS FOR ATTACHMENT TO A PRIMARY CHLORINE CONTAINER

This application is a continuation-in-part of application Ser. No. 09/452,398, filed on Dec. 1, 1999.

BACKGROUND OF THE INVENTION

1. Field of the Invention:

The present invention relates generally to the field of environmental protection mechanisms and procedures. More specifically the present invention relates to a secondary containment cap apparatus for sealingly securing over a turret or other critical portion of a hazardous gas primary container, to provide the container with a shield against leakage into the natural environment. Such primary containers may be free-standing or vehicle-mounted. The hazardous gas within the primary container is a gas which is poisonous, caustic or otherwise health threatening, such as chlorine and sulphur dioxide liquified gas.

For each type of primary container, the secondary containment cap apparatus fits to an exterior surface of the primary container and retains any gas leaking from the primary vehicle into the interior of the apparatus to prevent escape into the environment. The secondary containment cap apparatus in its essential form includes a substantially cup- or bubble-shaped cap wall defining a concave cap interior and a cap abutment port surrounded by a cap port rim shaped to follow and fit sealingly against a region of the primary container exterior surface to enclose this region, means for controlled release of gas within the cap wall into secure containers or scrubber means, and attachment means for securing the apparatus to the primary container with the port rim sealingly fitted against the primary container exterior surface.

2. Description of the Prior Art:

In recent years there have been numerous instances of chlorine gas released from bulk storage tanks, railroad tanker cars, tanker trucks and barges. Many communities have adopted new regulations requiring containment of toxic gas releases, such as Article 80 of the Uniform Fire Code and the Toxic Gas Ordinance. A problem with existing chlorine tanks and valves has been that they have no secondary containment, so that a release of chlorine from the tank or tank valving causes an instant and life threatening discharge of chlorine gas.

There have in recent years been devices intended for containing and scrubbing chlorine gas leaking from cylinders, and vehicles. These devices traditionally have included a hood or building structure placed around the leaking cylinder or vehicle and a scrubber apparatus for gradually removing the chlorine gas from the air within the hood or building. A problem with these devices has been that the containment buildings and hoods are not capable of withstanding the pressure and corrosive nature of suddenly released quantities of chlorine gas. Being largely intended for ton and 150 pound chlorine gas cylinders, such technology is wholly ineffective and unsuited for the large, perhaps 275 ton tanks found on chlorine transport vehicles and the sometimes massive stationary bulk storage tanks.

A solution to the problem of safely draining leaking chlorine cylinders has been found and is disclosed in U.S. Pat. No. 5,607,384 and 5,819,787, issued on Mar. 4, 1997 and Dec. 13, 1998, respectively, to the present applicant. These patents disclose sealing leaking chlorine cylinders in a pressure-withstanding secondary containment vessel, resembling on some ways an iron lung. Gas is slowly released through a valve in the secondary containment vessel to a scrubber apparatus of conventional design at a suitable metered rate. In the event of a catastrophic rupture and sudden release of gas from the cylinder, the secondary containment vessel entirely and safely contains the released gas, which once again is discharged at a suitable rate to a scrubber apparatus or put into process. A limitation to this approach is that it is impractical to build secondary containment vessels of the type disclosed in these patents which are large enough to receive bulk storage tanks and chlorine transport vehicles, and it is impractical to attempt to move such a leaking storage tank or tanker vehicle to the site of such a massive vessel or to move the massive vessel to and around the tanker vehicle. Additionally, there are so many sizes and shapes of tanks and transport vehicles that no single size and shape of receiving vessel could be suitable for all of them. Further a hood or alternative method may not fully comply with fire codes.

It is thus an object of the present invention to provide a secondary containment cap apparatus for enclosing a critical portion of a primary container such as a hazardous fluid containment bulk storage or vehicle tank, which is manufactured separately from the primary container, so that any fluid subsequently leaking from that critical portion of the primary container is contained within the containment cap apparatus and can be drained off through a port and valve in the apparatus into cylinders or other receiving means in the conventional way for ordinary usage. As a result, there is no need to go to the considerable expense of scrubbing the leaking fluid and no need to expose anyone to the dangers involved in such a clean-up operation.

It is more specifically an object of the present invention to provide such a cap apparatus which encloses the gas release port and valve of a primary container in such a limited secondary containment structure which is less expensive than providing secondary containment of the entire primary container.

It is an additional object of the present invention to provide such a cap apparatus in which the secondary containment cap is capable of withstanding the maximum hazardous fluid pressure which can be exerted by the quantity of retained hazardous fluid so that the natural environment is safely shielded from the hazardous fluid, and in which the primary container gas release port is fitted with a remote operating container valve which is operable from outside the containment cap apparatus so that the valve can be operated without entering the containment cap apparatus and no personnel are therefore exposed to leaking hazardous fluid.

It is a further object of the present invention to provide such a cap apparatus which is equipped with a hazardous fluid pressure/vacuum gauge and detection devices for indicating leaks and optionally for indicating completed draining of hazardous fluid from the cap structure.

It is still another object of the present invention to provide such a cap apparatus which complies with Article 80 of the Uniform Fire Code and with the California Toxic Gas Ordinance.

It is yet another object of the present invention to provide such a cap apparatus which has a fail-safe valve connected to its release fitting, the fail-safe valve being electrically wired to a motion and impact sensor, and connected to a hazardous fluid leakage sensor, which rapidly closes the fail-safe valve in the event of an earthquake, an attempt to move the primary container, or a hazardous fluid leak, and such a cap apparatus which has an on-board alarm system, with backup emergency power.

It is finally an object of the present invention to provide such a cap apparatus which is highly reliable and can be manufactured at an expense relatively comparable to that of existing containment systems.

SUMMARY OF THE INVENTION

The present invention accomplishes the above-stated objectives, as well as others, as may be determined by a fair reading and interpretation of the entire specification.

A secondary containment cap apparatus is provided for securing to a primary container containing a hazardous fluid, the primary container having a primary container wall with a primary container hazardous fluid passing port and a primary container wall exterior surface, the secondary containment cap apparatus including a cap wall defining a concave cap interior and a cap abutment port, the cap abutment port having a cap port rim, the cap abutment port and cap port rim being configured to fit closely against and follow the primary container wall in sealing relation with the primary container wall exterior surface and thereby to enclose a region of the primary container wall exterior surface to provide secondary containment over the region of the primary container wall exterior surface; a mechanism for controlled release of the fluid through the cap wall; and a mechanism for securing the cap wall to the primary container so that the cap port rim rests against the primary container wall exterior surface.

The mechanism for controlling release preferably includes a cap wall hazardous fluid passing port; and a conduit structure interconnecting the primary container hazardous fluid passing port and the cap wall hazardous fluid passing port. The apparatus preferably additionally includes a primary container valve in fluid communication with and mounted between the primary container hazardous fluid passing port and the conduit structure for controlling the flow of hazardous fluid from the primary container into the conduit structure. The primary container valve preferably is a remotely operated valve having a remote control mechanism external to the cap wall. The conduit structure preferably is a flexible line.

The apparatus preferably additionally includes a first cap wall valve in fluid communication with the cap wall hazardous fluid passing port and the conduit structure. The first cap wall valve preferably is a fail-safe valve. The apparatus preferably additionally includes a second cap wall valve outside the cap wall and in fluid communication with the cap wall hazardous fluid passing port. The second cap wall valve preferably is a manually operated valve.

The apparatus preferably additionally includes a motion detection mechanism mounted to the primary container and including a mechanism for detecting movement of the primary container caused by earthquakes and other movement of the primary container and further including a signalling device in communication with the fail-safe valve for automatically closing the fail-safe valve upon detection of primary container. The apparatus preferably additionally includes an external hazardous fluid detection device mounted to the primary container and including a device for detecting the presence of hazardous fluid outside the primary container, and further including a signalling device in communication with the fail-safe valve for automatically closing the fail-safe valve upon detection of hazardous fluid outside the primary container. The apparatus preferably additionally includes alarm sound generation device connected to the motion detection device signaling device for automatically initiating the generation of an alarm sound upon detection of primary container movement. The apparatus preferably still additionally includes an alarm sound generation device connected to the external hazardous fluid detection device signaling device for automatically initiating the generation of an alarm sound upon detection of hazardous fluid outside the primary container. The apparatus preferably still further includes a reduced orifice fitting sealingly secured within the cap wall hazardous fluid passing port for limiting the rate of hazardous fluid discharge from the primary container tank in the event of unintended hazardous fluid release.

The apparatus preferably additionally includes a second internal hazardous fluid detection device located between the primary container wall and the cap wall for detecting leakage of hazardous fluid from the primary container, the second internal hazardous fluid detection device having a second internal hazardous fluid detection device signal circuit extending through the cap wall and having a second internal hazardous fluid detection device display mechanism mounted to the primary container wall exterior surface. The cap wall preferably includes an outer access port and an outer access hatch removably covering and sealing the outer access port.

A secondary containment apparatus is further provided for hazardous fluids, including a primary container containing a hazardous fluid, the primary container having a primary container wall with a primary container hazardous fluid passing port and a primary container wall exterior surface; a secondary containment cap apparatus including a cap wall defining a concave cap interior and a cap abutment port, the cap abutment port having a cap port rim, the cap abutment port and cap port rim being configured to fit closely against and follow the primary container wall in sealing relation with the primary container wall exterior surface and thereby to enclose a region of the primary container wall exterior surface to provide secondary containment over the region of the primary container wall exterior surface; a mechanism for controlled release of the fluid through the cap wall; and a mechanism for securing the cap wall to the primary container so that the cap port rim rests against the primary container wall exterior surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
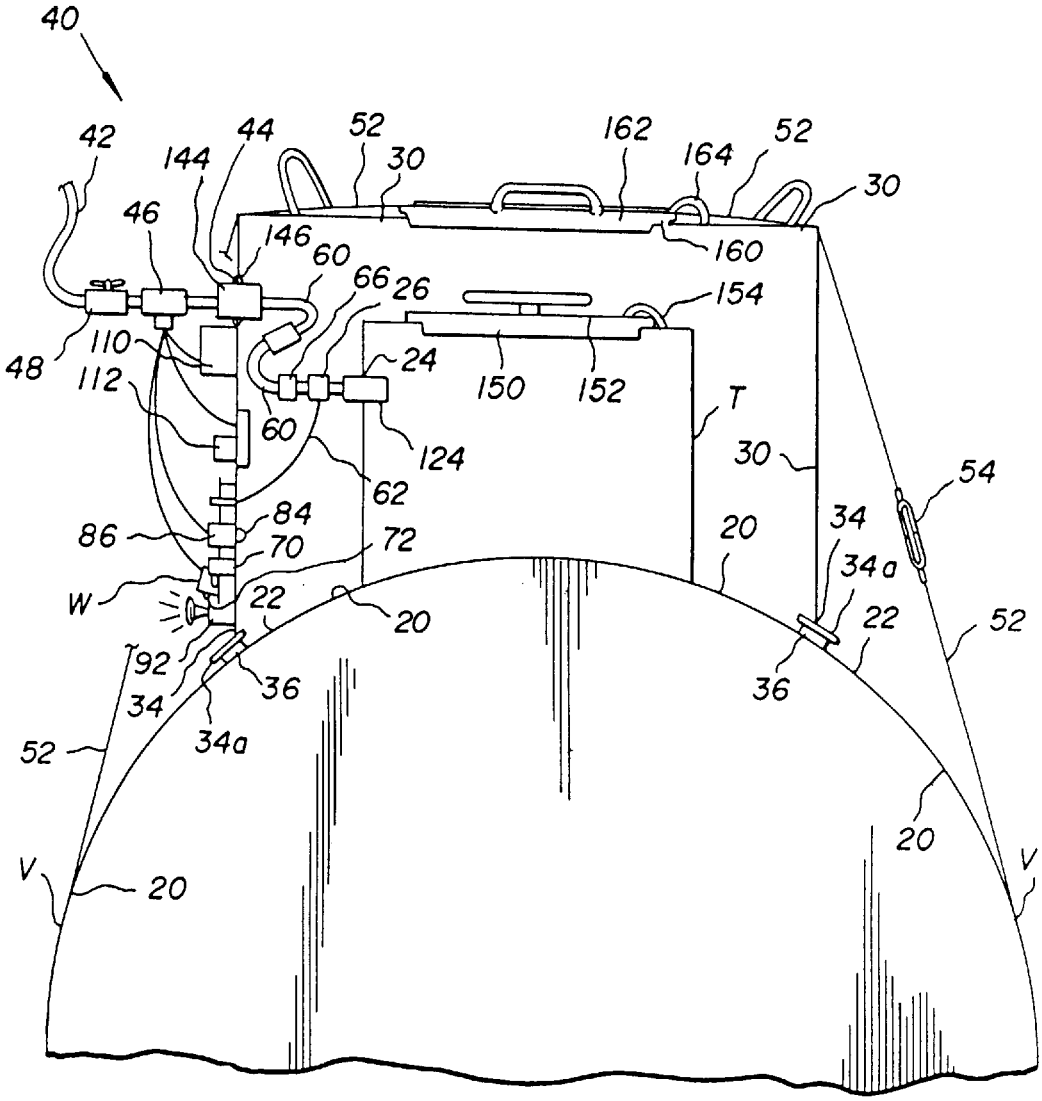
FIG. 1 is a cross-sectional end view of a vehicle tank, such as a railroad tank car, fitted with the inventive secondary containment cap apparatus.
Figure 2:
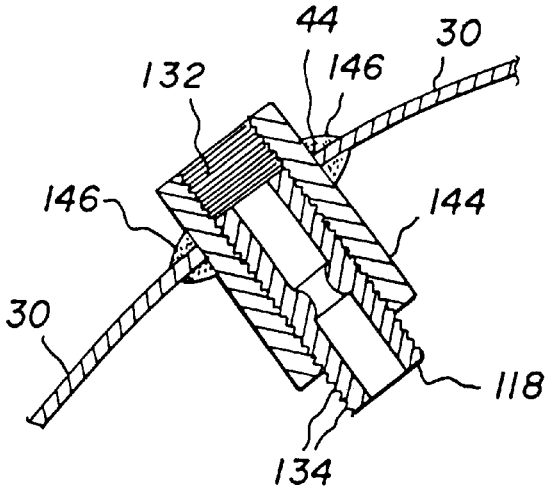
FIG. 2 is a partial cross-sectional end view of the secondary containment cap wall, also showing the secondary containment cap wall chlorine passing port and reduced orifice fitting in cross-section.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–6, a secondary containment cap apparatus 10 is disclosed for sealingly securing over a turret T or other critical portion of a hazardous gas primary container 20, to provide the container 20 with a shield against leakage into the natural environment. Such primary containers 20 may be free-standing or vehicle-mounted. The hazardous gas within the primary container 20 is a gas which is poisonous, caustic or otherwise health threatening, such as chlorine and sulphur dioxide liquified gas.

The term "primary container" for purposes of this application includes but is not limited to bulk storage tanks B and tank carrying vehicles V such as railroad tanker cars, tanker trucks and barges. Primary container 20 has an exterior surface 22 and a primary container fluid passing port 24. The term "fluid" for purposes of this application broadly includes liquids and gases, whether existing separately or in combination with each other within the primary container 20. For each type of primary container 20, the secondary containment cap apparatus 10 fits to an exterior surface 22 of the primary container 20 and retains any fluid leaking from the enclosed critical portion of the primary container 30 into the interior of apparatus 10 to prevent escape into the environment.

The secondary containment cap apparatus 10 in its essential form includes a substantially cup- or bubble-shaped cap wall 30 defining a concave cap interior and a cap abutment port 32 surrounded by a cap port rim 34 shaped to follow and fit sealingly against a region of the primary container exterior surface 22 to enclose this region, discharge means 40 for controlled release of fluid within the cap wall 30 into secure containers or scrubber means, and attachment means 50 for securing apparatus 10 to the primary container 20 with the port rim 34 sealingly fitted against the primary container exterior surface 22. The port rim 34 preferably includes a sealing flange 34*a* oriented to rest flat against the primary container exterior surface 22 to broaden the contact area between the port rim 34 and the primary container exterior surface 22, and a sealing gasket 36 for placement between the sealing flange 34*a* and exterior surface 22.

The attachment means 50 preferably includes one or a combination of chains or cables 52 for wrapping around cap wall 30 and around the primary container 20, and pulling means 54 for pulling the chain or cable 52 taut to firmly and sealingly hold the cap port rim 34 against the primary container exterior surface 22. See FIGS. 1 and 3–6. For cables 52, the preferred pulling means 54 is a turnbuckle, as shown or a pulling device known as a "come-along" (not shown). For chains, the preferred pulling means is a conventional ratchet mechanism (not shown) used for pulling chains taut. These pulling means preferably interconnect the two ends of each cable 52 or chain, and additionally may be provided intermittently throughout the length of the cable or chain. All are of designs well known in various arts.

The cap wall 30 is made of any suitable metal or plastic material which is capable of withstanding the fluid maximum pressure and of resisting the caustic nature of the contained fluid. The sealing gasket 36 is preferably made of a compressible chlorine-resistant material known as VITON™, although numerous other materials which would be resistant to the given contained hazardous fluid are contemplated.

The discharge means 40 for controlled release of fluid within the cap wall 30 includes cap wall fluid passing port 44 and an inter-container conduit 60 which preferably takes the form of a high pressure flex-line interconnecting hazardous fluid passing ports 24 and 44 in walls of the primary container 20 and secondary containment cap apparatus 10, respectively.

Cap wall 30 preferably further includes flow control means, fluid detection and monitoring means for providing information about the presence and pressure of any fluid within the cap apparatus 10.

The flow control means preferably include four valves and a pressure relief device. Two of the valves preferably have fail-safe design. Two are preferably manually operated. The fail-safe valves each include an external fluid detection device. An on-board alarm system is also preferably provided. A remote controlled primary container valve 26 is fitted to primary container fluid passing port 24 and is in fluid communication with inter-container conduit 60, and is preferably connected by an automation supply line 62 to a remote control switch 64 secured to the exterior of cap wall 30. As a result, no personnel need enter the cap apparatus 10 and risk exposure to any fluid leakage to operate the primary container valve 26. Primary container valve 26 is also known as a process valve. A second primary container valve 66 is optionally provided in the form of a manually operated valve mounted within and in fluid communication with inter-container conduit 60, for use as an alternative to the remote operation valve 26. A cap wall valve 46 is fitted to cap wall 30 fluid passing port 44, preferably outside cap wall 30, and is in fluid communication with inter-container conduit 60 and with any external discharge line 42 which may be secured to primary container 20. Cap wall valve 46 is preferably a fail-safe valve, and will be identified as such in the description which follows, and functions to shut off the flow of chlorine gas or other fluid through inter-container conduit 60 and out of the primary container 20 at the moment any one of several possible hazardous conditions develop. A second cap wall valve 48 is optionally provided in the form of a manually operated valve mounted to and in fluid communication with fail-safe valve 46 and takes the form of a manually operated valve for use as a mechanical backup should the fail-safe valve 46 or any of its remote triggering means fail to operate properly. Additionally redundant valves (not shown) are contemplated and optionally provided.

The detection and monitoring devices include an external fluid detection device 70 having a first sensor 72 located outside and secured to the cap wall 30, for sensing the presence of chlorine or other contained fluid in the atmosphere surrounding cap apparatus 10. Provided is an internal pressure/vacuum gauge 74 having a second sensor ported into cap wall 30 to indicate the point at which substantially all fluid has been drained from within the cap wall 30 and also indicates the presence of any fluid leaked from the primary container 20. Each of these fluid detection devices 70 and 74 are connected to an indicator light or gauge 86 on a control panel 90 mounted on the exterior of cap wall 30 or elsewhere on the cap apparatus 10. The external fluid detection device 70 is also wired to the fail-safe valve 46 and to an audible alarm system 92 to warn persons in close proximity to cap apparatus 10 of chlorine exposure or other fluid exposure danger. An alarm system battery 94 as well as alarm system back-up batteries or a generator (not shown) are connected to and power the audible alarm system 92, which may also flash alarm lights.

As an alternative to internal fluid detection device 70, a remote operated leak-test valve (not shown) is provided. This leak-test valve is "cracked", or opened slightly, to determine if any chlorine or other contained fluid remains between the primary container 20 and cap wall 30.

Fail-safe valve 46 is preferably a nitrogen powered-electric valve which has a one thousand-pound valve closure biasing spring and is connected by fail-safe valve operational wiring W: to a motion sensor 110 which sends a signal over the circuit wiring to close the fail-safe valve 46 upon detection of unauthorized primary container 20 movement or upon detection of an earthquake; to the external fluid detection device 70 as mentioned above, which sends a signal over the wiring C to close the fail-safe valve 46 upon detection of chlorine or other contained fluid in the atmosphere outside cap wall 30; to a power supply monitor 112 which sends a signal over the wiring C in the event of electric power failure; and finally to a nitrogen supply line (not shown) which supplies nitrogen to keep the fail-safe valve 46 open against the biasing of the one thousand-pound spring which permits the biasing spring to close the fail-safe valve 46 upon interruption of the flow of nitrogen to fail-safe valve 46.

The cap wall fluid passing port 44 preferably has a secondary port fitting 144 which is secured with a weld 146 into the cap wall fluid passing port 44. The secondary port fitting 144 preferably has internal threads 132 and a reduced orifice fitting 118 having external threads 134 is preferably screwed into the port fitting 144. See FIG. 2. The purpose of the reduced orifice fittings 118 is to limit the rate of chlorine or other contained fluid discharge in the event of damage to or malfunction of the secondary port fitting 144.

A primary container wall 22 in some instances includes a manhole access port 150 fitted with a manhole access hatch 152 mounted at the edge of the manhole access port 150 which seals the primary container 20 when closed and can withstand the pressure of the chlorine or other fluid retained within the primary container 20. The cap wall 42 preferably includes an outer access port 160 fitted with an outer access hatch 162 mounted at the edge of the outer access port 160 on hinges 164 for human entry into cap wall 30 and which seals cap apparatus 40 when closed and can withstand the pressure of the chlorine or other fluid retained within the primary container 20.

It is preferred that there is a pressure relief device 78 in cap wall 30. Pressure relief device 78 protects the cap apparatus 40 from rupture due to over pressurization. References in this description to chlorine are merely exemplary of hazardous fluids generally which are capable of containment in tanks.

Second Preferred Embodiment

Figure 7:
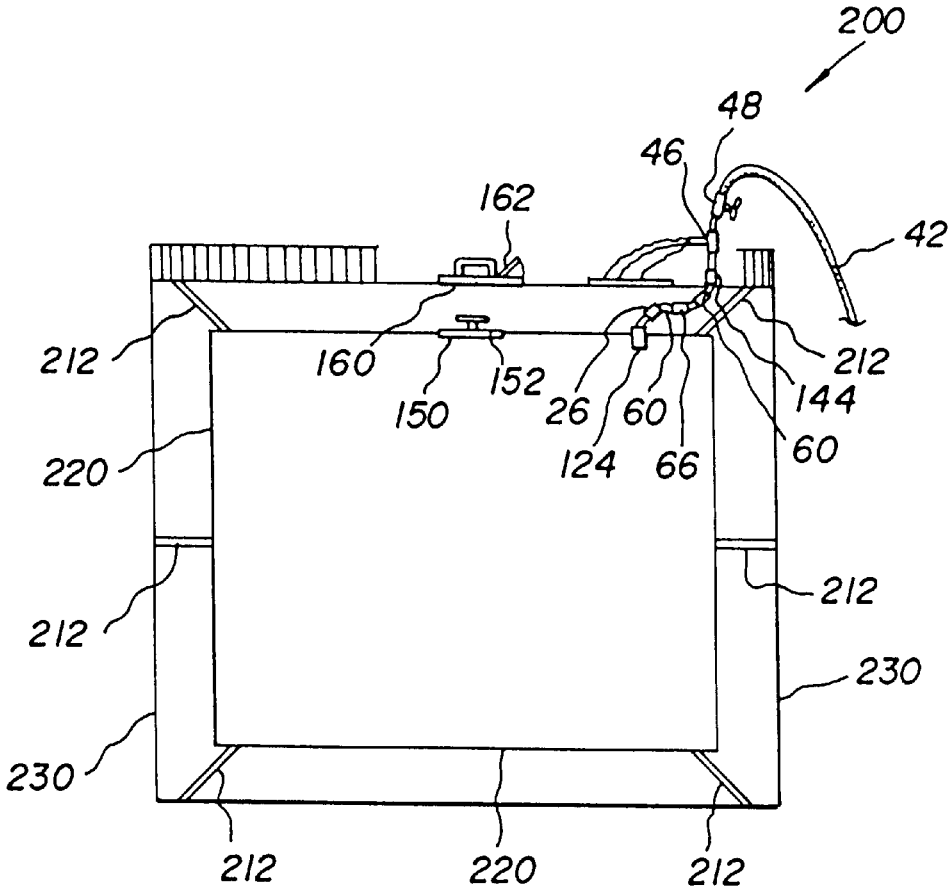
FIG. 7 is a cross-sectional side view of the bulk storage tank of the second embodiment, showing the full secondary containment provided by the outer secondary container, the interconnecting struts unifying and spacing apart the primary and secondary containers, and showing generally the various ports, inter-container conduit means, valves, valve controls, monitoring devices and maintenance access elements provided as well for the first embodiment.
Figure 3:
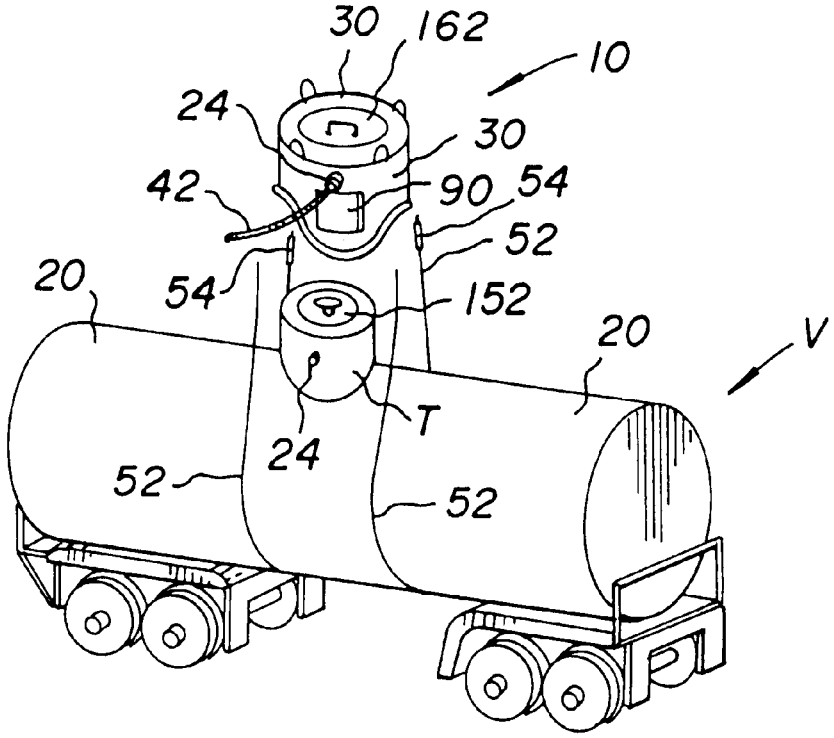
FIG. 3 is a perspective side view of a railroad tank car and of the inventive cap apparatus configured to fit against the tank car primary container exterior surface being lowered onto the tank car.
Figure 4:
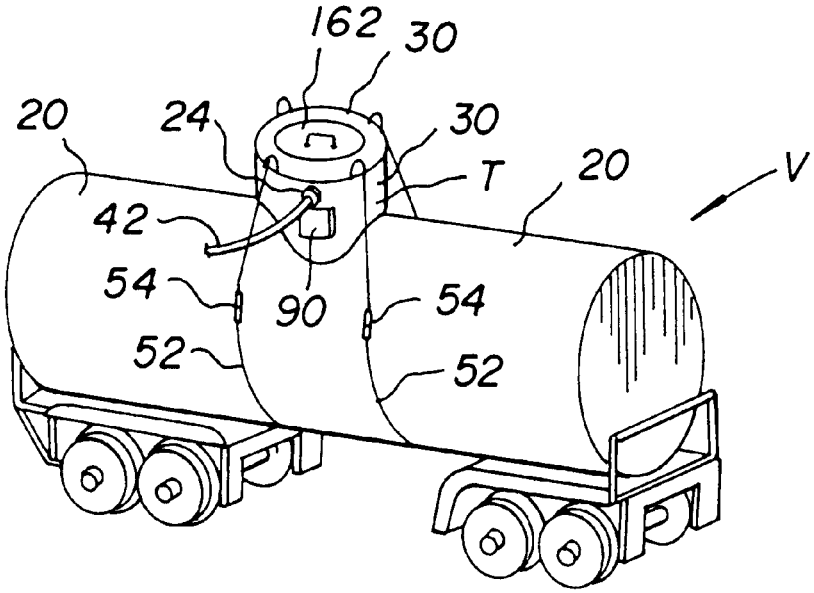
FIG. 4 is a view as in FIG. 3, showing the cap apparatus lowered into place on the tank car and anchored to the car primary container with cables equipped with turnbuckles.
Figure 5:
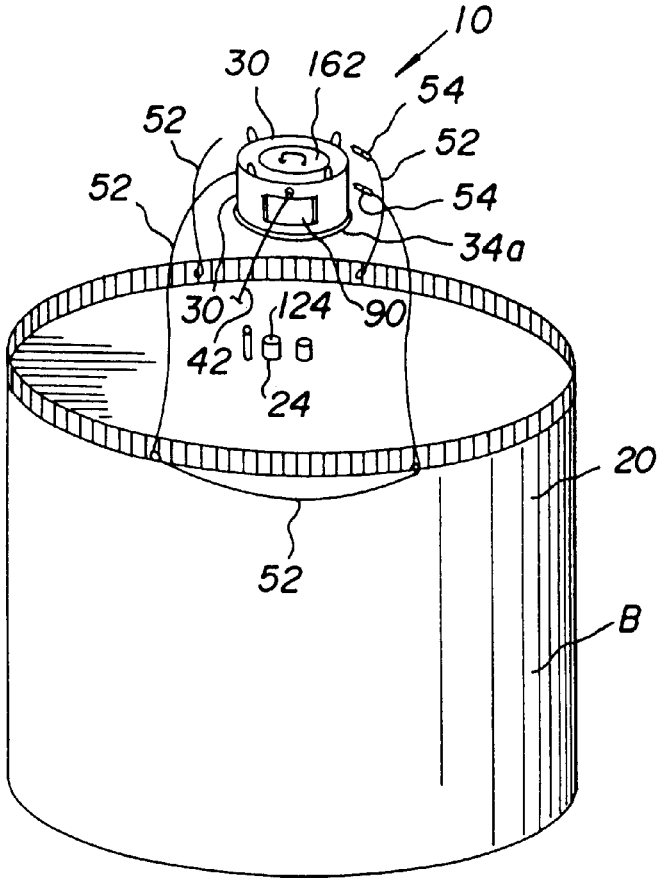
FIG. 5 is a perspective side view of a bulk storage tank and of the inventive cap apparatus configured to fit against the bulk storage tank exterior surface being lowered onto the tank.
Figure 6:
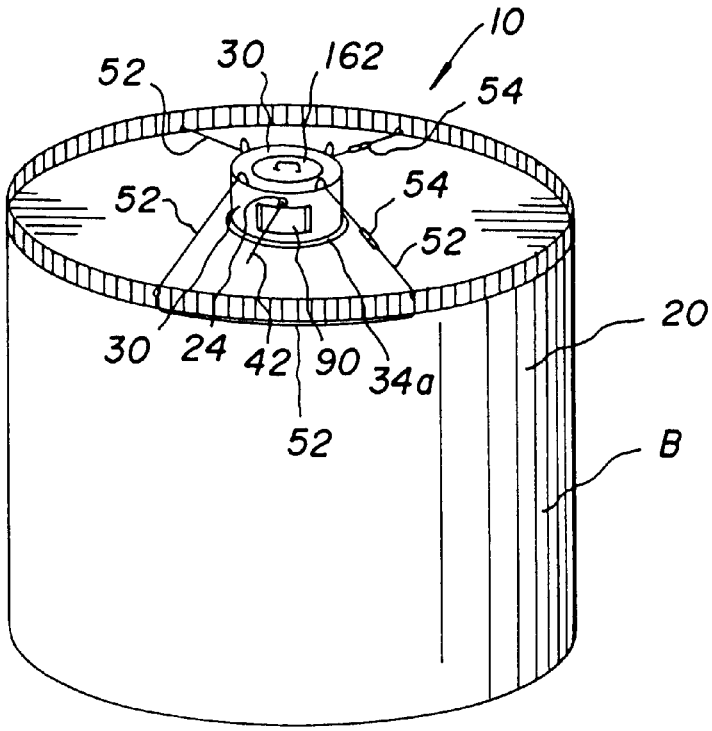
FIG. 6 is a view as in FIG. 5, showing the cap apparatus lowered into place on the bulk storage tank and anchored to the tank with cables equipped with turnbuckles.

A second embodiment of the apparatus is provided for bulk storage, in the form of a bulk storage tank 200 having full secondary containment. Essentially the bulk storage tank 200 includes a primary container 220 and a secondary container 230 entirely enclosing the primary container 220. Interconnection struts 212 extend between the primary container 220 exterior surface and the secondary container 230 interior surface. See FIG. 7. Struts 212 unify containers 220 and 230 as a single structure and space the walls of these containers apart from each other. Struts 212 are preferably made of a suitable metal and are welded at their ends to the primary and secondary containers 220 and 230, respectively. A virtually limitless variety of shapes and sizes of bulk storage tanks 200 are contemplated, FIG. 7 being illustrative of only one of these.

An inter-container conduit 60 is provided, as for the first embodiment. Monitoring devices, valves and controls are also provided as described for the first embodiment and therefore are not shown in detail in FIG. 7. This container structure is virtually identical to the secondary containment structures described in parent application 09/452,398, the disclosure of which is incorporated herein by reference, but with the vehicle elements such as the vehicle bed, wheels or barge walls excluded.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A storage tank for containing hazardous fluids, comprising:

a tank comprising a primary container having a primary container wall with a primary container hazardous fluid passing port and with an inner human access port and an inner human access hatch removably covering and sealing said inner human access port; a secondary container containing said primary container and having a secondary container wall with a secondary container hazardous fluid passing port and with an outer human access port positioned to register with said inner human access port and with an outer human access hatch removably covering and sealing said outer human access port; and inter-container conduit means extending between and in fluid communication with said primary container hazardous fluid passing port and with said secondary container hazardous fluid passing port and creating fluid communication between said primary container and said secondary container hazardous fluid passing ports.

2. The storage tank of claim 1, additionally comprising a primary container valve in fluid communication with and mounted between said primary container hazardous fluid passing port and said conduit means for controlling the flow of hazardous fluid from said primary container into said conduit means.

3. The vehicle of claim 1, wherein said primary container valve is a remotely operated valve having remote control means external to said secondary container.

* * * * *